US005899013A

United States Patent [19]

Hauser et al.

[11] Patent Number: 5,899,013

[45] Date of Patent: May 4, 1999

[54] MAGAZINE LOCK FOR A PORTABLE FIREARM

[75] Inventors: Akasius Hauser, Schaffhausen; Roger Meili, Neuhausen am Rheinfall, both of Switzerland

[73] Assignee: Sig Arms International AG, Switzerland

[21] Appl. No.: 09/157,907

[22] Filed: Sep. 21, 1998

[30] Foreign Application Priority Data

Oct. 1, 1997 [DE] Germany ..... 197 43 557

[51] Int. Cl.[6] ..... F41A 9/61; F41A 9/67

[52] U.S. Cl. ..... 42/6

[58] Field of Search ..... 42/6, 18, 22; 89/37.04

[56] References Cited

U.S. PATENT DOCUMENTS

| | | | |
|---|---|---|---|
| 2,657,489 | 11/1953 | Robertson, Jr. | 42/6 |
| 3,088,378 | 5/1963 | Boudreau | 42/6 |
| 3,574,264 | 4/1971 | Simmons | 42/6 |
| 3,715,826 | 2/1973 | Seifried | 42/6 |
| 4,237,638 | 12/1980 | Trexler | 42/6 |
| 4,815,226 | 3/1989 | Ruger | 42/6 |
| 5,519,954 | 5/1996 | Garrett | 42/6 |

*Primary Examiner*—Charles T. Jordan
*Assistant Examiner*—Denise J Buckley
*Attorney, Agent, or Firm*—Webb Ziesenheim Logsdon Orkin & Hanson, P.C.

[57] ABSTRACT

The magazine lock includes a housing (1) with a magazine opening (2) and a trigger guard (3). In the housing (1), a two-armed, spring-loaded locking lever (7) is mounted so that it can pivot. The first arm (10) projects inside the trigger guard (3) for actuation. The second arm (12) is engaged in a recess (6) of the magazine (4). Hinged to the first arm (10) is a slide (24) which surrounds the magazine opening (2). The slide (24), on the second side facing the magazine (4), has a pin (28) which is engaged in a second recess (5) on the facing side of the magazine (4). The result is a secure locking of the magazine with a locking device which occupies very little vertical space.

13 Claims, 1 Drawing Sheet

1
2
3
4
4a
5
6
7
8
10
11
12
14
16
17
28

8
21
7
10
11
15
13
16
24
25
26
27
28

2
29
17
9
22
23
3

29
30
28
4
27
5
1

MAGAZINE LOCK FOR A PORTABLE FIREARM

BACKGROUND OF THE INVENTION

Magazine locks are generally attached on one side in a housing with a magazine opening.

For example, U.S. Pat. No. 2,632,272 describes a magazine lock of the prior art on a weapon. On the front side, the magazine has a cam which is inserted into a corresponding recess in the magazine shaft. The magazine is then pivoted toward the back. The rear edge of the magazine has a projection which, when the magazine is pivoted, presses a notch lever and following the insertion, snaps in place behind the magazine. In the magazine shaft, on the cam side, there is an additional retaining device, the purpose of which is to prevent the magazine from being inserted when the weapon is not ready for operation.

SUMMARY OF THE INVENTION

The object of the invention is to create a secure magazine lock even for magazines that are guided over a relatively short distance. This object is achieved by providing a magazine lock having a magazine opening and a trigger guard. A two-arm, spring-loaded detent lever is pivotally mounted in the housing. A first arm of the detent lever projects inside the trigger guard for actuation and a second arm of the detent lever engages a first recess on a first side of a magazine. A slide is connected to the first arm, with the slide surrounding the magazine opening and having a projection configured to engage a second recess on a second side of the magazine.

BRIEF DESCRIPTION OF THE DRAWINGS

One exemplary embodiment of the invention is described in greater detail below and is illustrated in the accompanying drawings, in which.

Figure 1:
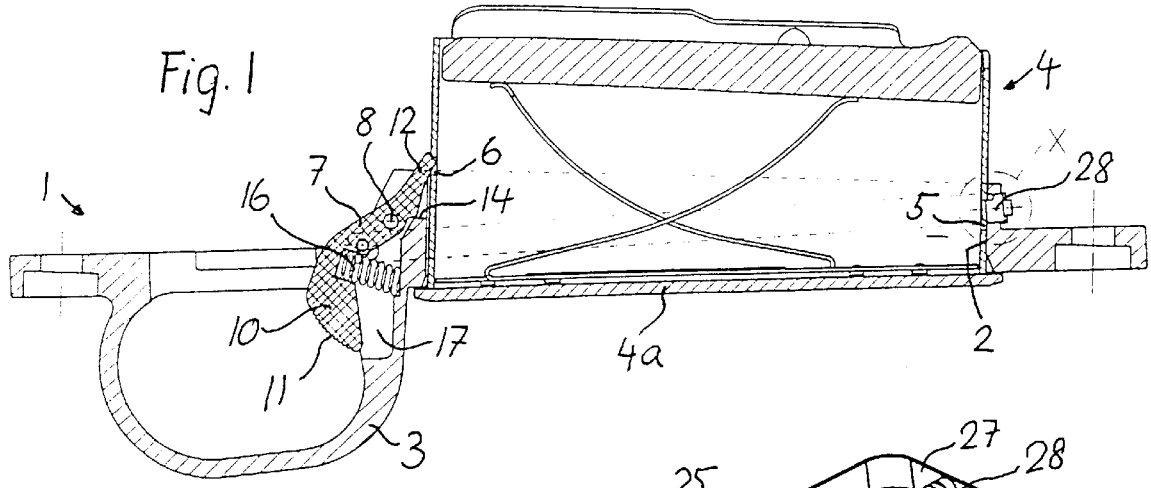
FIG. 1 is a vertical section through a magazine lock of the invention.
Figure 2:
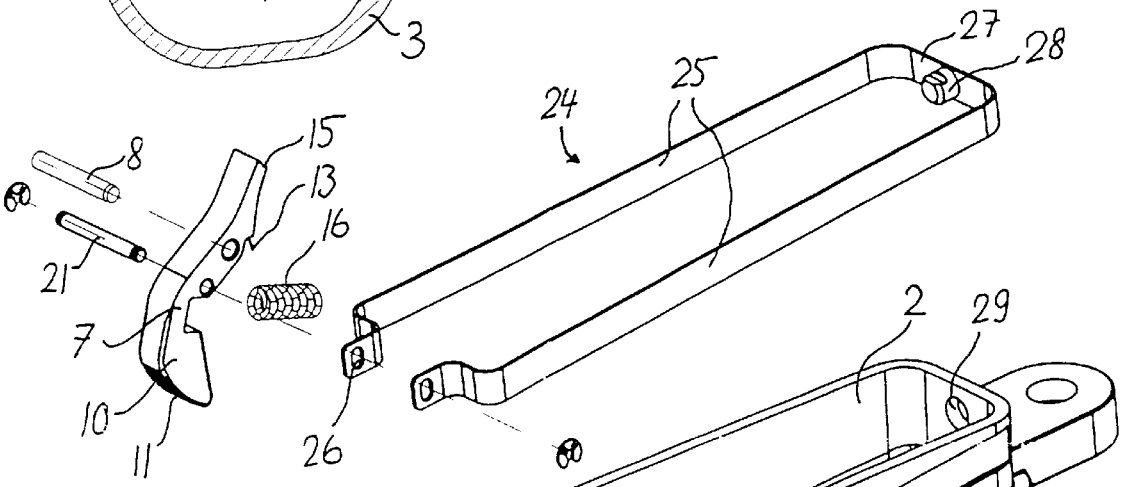
FIG. 2 is an exploded view of the parts of the lock.
Figure 2:
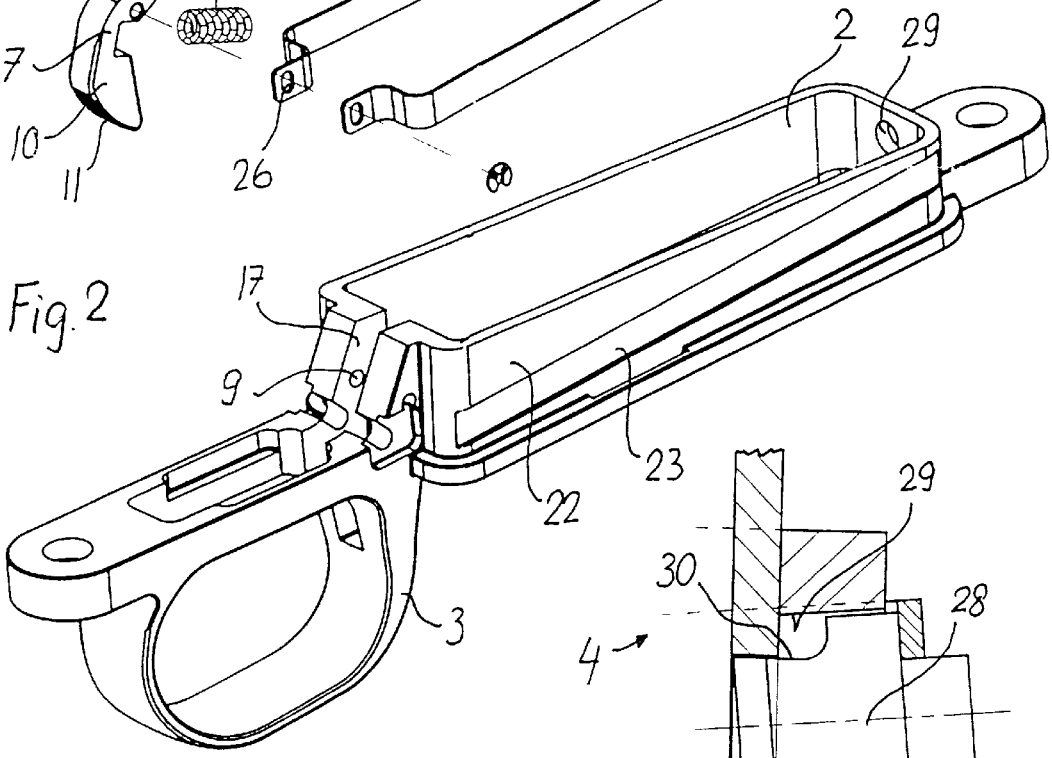

The magazine lock depicted in the accompanying drawings comprises a housing 1 with a magazine opening 2 and a trigger guard 3, into which, in the assembled state, a trigger projects. A magazine 4 may be inserted into the magazine opening 2. The magazine 4 has rectangular openings or recesses 5, 6 on the front and back walls, respectively. The magazine base 4*a* projects beyond the bottom of the magazine opening 2. On the forward part of the trigger guard 3 there is a two-armed locking or detent lever 7 which is rotatably mounted on a cylindrical pin 8. The cylindrical pin 8 is pressed into a bore 9 in the housing 1. The first arm 10 of the detent lever 7 projects inside the trigger guard 3 and has a ribbed gripping surface 11 so that it can be actuated with the thumb. The second arm 12 of the detent lever 7 has a contact surface 13 which, when the magazine 4 is not inserted, rests against a shoulder 14 of the housing 1. On an outer or free end, the second arm 12, which projects upward at an angle, has a locking notch 15 which engages in the recess 6. Pressure is applied to the first arm 10 by a biased compression spring 16 which is supported on the housing 1. The detent lever 7 is guided in a groove 17 of the housing 1.

Figure 3:
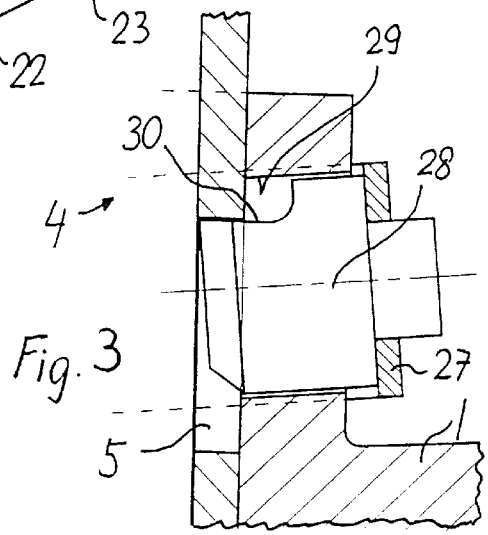
FIG. 3 is a detail X from FIG. 1, on a larger

On the first arm 10, at some spaced distance from the cylindrical pin 8, a second cylindrical pin 21 is inserted. The two side walls 22 of the magazine opening 2 each have a longitudinal groove 23. A U-shaped slide 24 is inserted and guided in these longitudinal grooves 23. The slide 24, on the free ends of its legs 25, has two slots 26 that extend at right angles to its longitudinal axis. The cylindrical pin 21 runs through these slots 26, so that when the first arm 10 of the locking lever 7 is pushed, the slide 24 is moved forward. A cylindrical pin 28 is riveted into a web 27 of the slide 24. The pin 28 is guided in a bore 29 of the housing 1 and has a flattened area 30 on top which is engaged in the upper edge of the recess 5. As shown in FIG. 3, the free or front end of the pin 28 has a conical taper, so that the pin 28 is pushed in when the magazine 4 is inserted. Alternatively, there can also be a wedge surface ground onto the lower edge of the pin 28.

The magazine lock described above locks the magazine 4 on two opposite narrow sides simultaneously and therefore requires guidance over only a short distance in the magazine opening 2. It therefore occupies only a small amount of vertical space and is suitable for use even with very short magazines 4 that hold only a few cartridges. It is very simple and ergonomically efficient to operate.

What is claimed is:

1. A magazine lock for a portable firearm, comprising:

a housing having a magazine opening and a trigger guard;

a two-armed, spring-loaded detent lever pivotally mounted in the housing, wherein a first arm of the detent lever projects inside the trigger guard for actuation and a second arm of the detent lever engages a first recess on a first side of a magazine inserted into the magazine opening;

a slide connected to the first arm, the slide surrounding the magazine opening and having a projection configured to engage a second recess on a second side of the magazine when the magazine is inserted into the magazine opening.

2. The magazine lock as claimed in claim 1, wherein the projection is a pin which is guided in a bore of the housing.

3. The magazine lock as claimed in claim 2, wherein the pin has, on an upper side, a flattened area configured to engage an upper edge of the second recess when the magazine is inserted, and wherein the pin, on a bottom end, has a bevel surface which can be pushed in when the magazine is inserted.

4. The magazine lock as claimed in claim 1, wherein the slide surrounds the magazine opening on at least two sides.

5. The magazine lock as claimed in claim 4, wherein the magazine opening has sidewalls with longitudinal grooves and the slide is inserted in the longitudinal grooves on side walls of the magazine opening.

6. The magazine lock as claimed in claim 1, wherein the detent lever has a stop which, in a base position, contacts the housing.

7. The magazine lock as claimed in claim 2, wherein the slide surrounds the magazine opening on at least two sides.

8. The magazine lock as claimed in claim 3, wherein the slide surrounds the magazine opening on at least two sides.

9. The magazine lock as claimed in claim 2, wherein the detent lever has a stop which, in a base position, contacts the housing.

10. The magazine lock as claimed in claim 3, wherein the detent lever has a stop which, in a base position, contacts the housing.

11. The magazine lock as claimed in claim 4, wherein the detent lever has a stop which, in a base position, contacts the housing.

12. The magazine lock as claimed in claim 5, wherein the detent lever has a stop which, in a base position, contacts the housing.

13. A firearm magazine lock for reversibly locking a magazine having a first side with a first recess and a second side with a second recess into the firearm, the lock comprising:

a housing having a magazine opening and a trigger guard;

a detent lever pivotally mounted in said housing, said detent lever having a first arm and a second arm, said first arm projecting into said trigger guard and said second arm configured to engage the first magazine recess when the magazine is inserted into said lock;

a slide connected to said first arm and slidably carried in said housing, said slide including a projection configured to engage the second magazine recess when the magazine is inserted into said magazine opening.

* * * * *